US010415761B2

(12) United States Patent
Schneider et al.

(10) Patent No.: US 10,415,761 B2
(45) Date of Patent: Sep. 17, 2019

(54) ILLUMINATING OBJECT

(71) Applicant: Smolsys AG, Root (CH)

(72) Inventors: Sandro M. O. L. Schneider, Thalwil (CH); Patrick P. Burkhalter, Meggen (CH)

(73) Assignee: Smolsys AG, Root (CH)

( * ) Notice: Subject to any disclaimer, the term of this patent is extended or adjusted under 35 U.S.C. 154(b) by 0 days.

(21) Appl. No.: 16/319,711

(22) PCT Filed: Jan. 9, 2018

(86) PCT No.: PCT/EP2018/050406

§ 371 (c)(1),
(2) Date: Jan. 22, 2019

(87) PCT Pub. No.: WO2018/137918

PCT Pub. Date: Aug. 2, 2018

(65) Prior Publication Data

US 2019/0242530 A1 Aug. 8, 2019

(30) Foreign Application Priority Data

Jan. 24, 2017 (CH) ..... 75/17

(51) Int. Cl.

| | |
|---|---|
| ***F21K 2/06*** | (2006.01) |
| ***F21K 2/00*** | (2006.01) |
| ***F21V 31/00*** | (2006.01) |
| ***F21V 15/01*** | (2006.01) |
| ***F21V 9/32*** | (2018.01) |

(52) U.S. Cl.

CPC ..... *F21K 2/00* (2013.01); *F21V 9/32* (2018.02); *F21V 15/01* (2013.01); *F21V 31/005* (2013.01)

(58) Field of Classification Search

None

See application file for complete search history.

(56) References Cited

U.S. PATENT DOCUMENTS

| | | | | |
|---|---|---|---|---|
| 3,238,139 A * | 3/1966 | Fischer | C09K 11/04 | 250/459.1 |
| 4,935,632 A * | 6/1990 | Hart | F21K 99/00 | 250/462.1 |
| 5,938,313 A * | 8/1999 | Fujita | F21K 2/06 | 362/34 |
| 6,062,380 A * | 5/2000 | Dorney | A47G 19/2227 | 206/217 |

(Continued)

FOREIGN PATENT DOCUMENTS

| | | |
|---|---|---|
| EP | 2 626 401 | 8/2013 |
| WO | WO 2014/033151 | 3/2014 |

OTHER PUBLICATIONS

FEMA: Tech Talk, U.S. Fire Administration, vol. 1, No. 1 (Rev.1), FEMA, Jul. 2009, 12 pages.

(Continued)

*Primary Examiner* — Elmito Breval

(74) *Attorney, Agent, or Firm* — Dority & Manning, P.A.

(57) ABSTRACT

An autonomous, permanently illuminating object includes a sheath that defines an interior space in which is disposed a glass capsule containing a gaseous tritium light source. The sheath defines a transparent region. A layer of photoluminescent pigments is disposed between the glass capsule and the transparent region of the sheath.

19 Claims, 2 Drawing Sheets

(56) References Cited

U.S. PATENT DOCUMENTS

| | | | | |
|---|---|---|---|---|
| 9,488,348 | B2 | 11/2016 | Kind et al. | |
| 2003/0137826 | A1* | 7/2003 | Nomiyama | F21K 2/06 362/34 |
| 2011/0120459 | A1* | 5/2011 | Ramos | A61B 1/0676 128/200.26 |
| 2016/0123540 | A1* | 5/2016 | Harada | B65B 51/22 362/34 |
| 2017/0144032 | A1* | 5/2017 | Jin | A63B 39/00 |

OTHER PUBLICATIONS

International Preliminary Report on Patentability, PCT/EP2018/050406, dated Dec. 5, 2018, 12 Pages.
International Search Report, PCT/EP2018/050406, dated Apr. 16, 2018, 4 pages.

* cited by examiner

ILLUMINATING OBJECT

CROSS-REFERENCE TO RELATED APPLICATIONS

This application claims priority to International Application Serial No. PCT/EP2018/050406 filed on Jan. 9, 2018, which claims priority to Swiss Application No. 00075/17, filed Jan. 24, 2017. International Application Serial No. PCT/EP201/050406 is hereby incorporated herein in its entirety for all purposes by this reference.

FIELD OF THE INVENTION

The invention relates to an autonomous, permanently illuminating object for identifying important points in bright conditions, poor lighting, and in darkness, in particular for installation in instruments or for attachment to items which must be found quickly in emergency situations, comprising a gaseous tritium light source (GTLS) configured as a glass capsule, which is fixed in a sheath having a transparent viewing area.

BACKGROUND OF THE INVENTION

Autonomously self-illuminating or photoluminescent objects are required, first and foremost, in clocks, on bezels, or in other instruments, for example, in the cockpit of aircraft in order to highlight the important points on indicators and labels of the instruments. Thus, the observer is able to read the setting of the instruments even in poor lighting or in darkness. Other examples of applications are sighting aids for weapons (sights). Such self-illuminating devices have no access to a power supply and are often very small. Even larger versions of such self-illuminating or photoluminescent objects are manufactured for other applications. In many countries, emergency exits, light switches, door handles, or other objects or locations, which must be found quickly in the event of a sudden power failure, are marked therewith. In addition, safety personnel identify certain important objects, for example, flashlights, using such self-illuminating markers.

Self-illuminating gaseous tritium light sources (GLTS), in particular, are known. These are closed glass capsules which are internally coated with a phosphor and are filled with the low-level radioactive tritium gas. Substances which can be excited via radiation to illuminate are colloquially referred to as phosphors. This effect is referred to as fluorescence and does not persist or only very briefly persists, for example, for approximately a few milliseconds. Examples of such substances are CRT phosphors, including zinc sulfide and zinc oxide, which glow in the presence of radioactive radiation.

Such radioluminescent capsules glow for decades, due to the long half-life of the tritium gas, and have proven to be highly effective. Since their permanent luminosity is rather weak, however, they are less noticeable in bright conditions, where they appear to be white. At dusk or in darkness, they are perceived by the human eye only after a while, when the eye has become accustomed to the darkness.

Light guides are also known, which collect the ambient light over a large area and release it at a certain, smaller area, whereby this area glows brightly. Disadvantages thereof are the large area which must be exposed to light, and the fact that the light guides do not glow in darkness.

Further known alternatives to luminescence are photoluminescent, so-called phosphorescent paints of the type often found on hands and points on clocks and on bezels. These paints, some of which continue to afterglow strongly and for a long time, are difficult to apply and must be well protected against environmental influences, in particular against moisture.

Document WO 2014/033151 (U.S. Pat. No. 9,488,318, which is hereby incorporated herein in its entirety by this reference for all purposes) provides a method for producing a permanent lamp, a GTLS, of the type mentioned at the outset. For this purpose, an inner wall of a glass hollow body is coated with a fluorescent and/or phosphorescent substance before the cavity is filled with a medium emitting a decaying radiation, and is hermetically sealed. The objective of this method is to cause the substance contained in the cavity to glow by way of the decaying radiation, to which the substance is permanently exposed.

Phosphorescence is generally understood to be the long afterglow of pigments, wherein the term is often confused with phosphor, which is responsible for the fluorescence which does not continue to glow. In the aforementioned document, zinc sulfide, zinc oxide, zinc cadmium, magnesium sulfide, and $Y_2O_2S$—all of which are fluorescent and not phosphorescent and, therefore, do not continue to glow or only very briefly continue to glow—are named as examples of such fluorescent and/or phosphorescent substances.

In contrast to radioluminescent substances, which are excited via radioactive radiation, photoluminescent materials are excited via photons, often via UV radiation, in particular. As a result, objects appear brighter in daylight, as is known from highlighters. Their molecules absorb energy from ultraviolet light and emit this energy in the form of visible light; they fluoresce and do not continue to glow.

BRIEF OBJECTS AND SUMMARY OF THE INVENTION

The problem addressed by the present invention is that of describing a permanently illuminating object of the type mentioned at the outset, which is clearly visible in bright conditions, at dusk, in poor lighting, and in darkness, can be very easily and securely installed, and allows for cost-effective production in large series. In addition, this lamp is to be capable of being universally installed in many devices without the need for adaptations.

This problem is solved by the features described below. Further advantageous embodiments also are described.

According to the invention, in the case of an autonomous, permanently illuminating object of the type mentioned at the outset, a layer, which is provided with photoluminescent pigments, is arranged at least in the region between the GTLS glass capsule and the viewing area. This layer is located outside the GTLS glass capsule.

Due to this arrangement, the lamp according to the invention glows very brightly in daylight on the entire viewing area because the pigments absorb and strongly reflect the daylight. The lamp is still clearly visible even in the gradual transition from daylight to dusk because the pigments have stored energy which they slowly emit in the form of light over the next 10 to 20 minutes. During this time, the eye becomes accustomed to the darker surroundings and can now increasingly better perceive the weaker, although constantly glowing, GTLS glass capsule. Since the GTLS glass capsule is always situated behind the photoluminescent pigments, as seen in the viewing direction, the observer always sees the luminous surface at the same point in daylight and in darkness. The observer does not notice when the luminosity of the photoluminescent pigments slowly weakens and the luminosity of the GTLS glass capsule correspondingly increases as the sensitivity of the eye increases, since the same viewing area always glows.

The GTLS glass capsule can be utilized in all the aforementioned applications, i.e., in particular even, although not exclusively, as a sighting aid, for identification on clocks, bezels, and instruments, as information aids in cases of emergency.

In the case of small GTLS glass capsules having a diameter of approximately 1 mm, the layer provided with the photoluminescent pigments is approximately 0.1 mm to 0.8 mm thick, depending on how great the portion of these pigments is. This layer can be even thicker in the case of larger and, therefore, brighter GTLS glass capsules.

The lamp according to the invention can also be produced cost-effectively in large series and can be easily installed in instruments, since it is easily handled as a solid structural member.

BRIEF DESCRIPTION OF THE DRAWINGS

The invention is explained in greater detail in the following with reference to the drawings. Wherein.

DETAILED DESCRIPTION OF THE DRAWINGS

Figure 1:
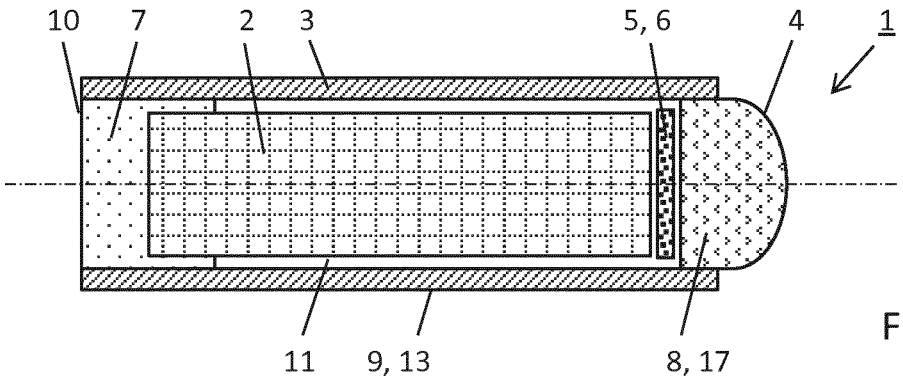
FIG. 1 shows a schematic representation in the section of a lamp according to the invention, in a simple form.
Figure 2:
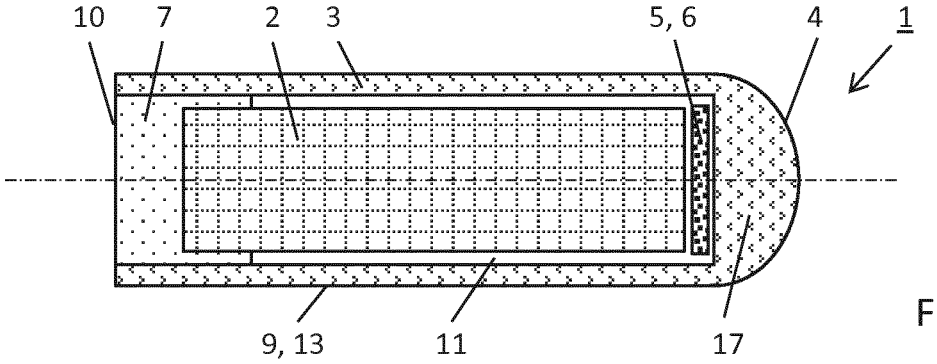
FIG. 2 shows a cross-section of one alternative embodiment.

FIGS. 1 and 2 show schematic representations of lamps 1 according to the invention. These are autonomous, permanently illuminating objects 1 which are generally rotationally symmetrical about a central axis that is schematically represented in the Figs. by a chain-dashed line. The core is formed, in each case, by a gaseous tritium light source (GTLS) configured as a glass capsule 2, which is of the type which is commercially available in rod-shaped, closed structures and was described at the outset. Each GTLS glass capsule 2 glows permanently for decades in the dark and can be clearly seen by the human eye as soon as the human eye has become nearly accustomed to the darkness. There is no need for a battery, a power source, or any other type of energy supply, for example, in the form of light, in order to illuminate a GTLS glass capsule 2. A GTLS glass capsule 2 is permanently autonomously luminous.

Since a GTLS glass capsule 2 contains a radioactive gas which is released when the glass capsule breaks, the GTLS glass capsule 2 must be installed in a well-protected manner in a housing in order to meet the legal conditions of most countries. For this reason, the GTLS glass capsule 2 is fixed in a sealed sheath 3 including a transparent viewing area 4. According to FIG. 1, the viewing area 4 can be part of a transparent component 8, such as the outer surface of a lens 17 which is made of glass, ceramic, or plastic, for example. This component 8 is sealingly mounted on one end of a tubular sheath 3, for example, with the aid of a press fit. The sheath 3 can be made of metal or plastic, for example.

Alternatively, as is represented in FIG. 2, the viewing area 4 can be part of the sheath 3 which is configured, as one piece, as a transparent tube closed on one side. The component 8 is therefore integrally formed on the sheath 3. In both cases, the sheath 3 defines an interior space 11 as well as a closed front end and, positioned opposite thereto, an open or rear end 10. The rear end 10 is open only for the production of the lamp 1; after production, the rear end 10 is also closed, for example, with the aid of a filling material 7 including an adhesive.

The GTLS glass capsule 2 is arranged in the closed interior space 11 of the sheath 3 in each case. According to the invention, a layer 6, which is provided with photoluminescent pigments 5, is arranged at least in the region between the GTLS glass capsule 2 and the viewing area 4. This has the effect, first of all, that the lamp 1 has a color, such as green or blue, when viewed through the viewing area 4 and, as a result, is more easily distinguished from the surroundings as a GTLS glass capsule 2 which is white in the daylight. In addition, the pigments 5 are fluorescent, whereby the viewing area 4 becomes more prominent: The pigments are excited due to the absorption of photons and are deactivated again while emitting light, which is known as photoluminescence.

A second effect is achieved after the light is gone: The pigments 5 continue to glow in the layer 6, whereby the pigments 5, in addition to the GTLS glass capsule 2, glow more intensely for the next few minutes, until the eye has become accustomed to the darkness. After the luminosity of the pigments 5 has faded away, the GTLS glass capsule 2 continues to glow through the layer 6 including the pigments and, finally, through the viewing area 4, which results in no noticeable reduction of the luminosity of the GTLS glass capsule 2.

Such a lamp 1 according to the invention is particularly well suited for identifying important points in bright conditions, poor lighting, and in darkness. The lamp 1 can be easily installed in instruments and devices 18 or mounted on objects or in locations which must be found quickly in emergency situations. It is advantageous for some applications when the user always perceives the luminosity of the lamp 1 to be uniformly bright even though the dominance of the luminosity gradually shifts, after the light is gone, from the photoluminescent pigments 5 to the GTLS 2. For this purpose, photoluminescent pigments 5 must be utilized, which continue to glow for approximately 15 minutes up to several hours, depending on the desired initial brightness and the transition time from the photoluminescent pigment to the GTLS.

Photoluminescence sources preferably comprising strontium aluminate ($SrA1_2O_4$) are preferably utilized as photoluminescent pigments 5. Various long-afterglow pigments 5 having different colors and afterglow times are available on the market, for example, under the name Super-LumiNova® from the company RC-Tritec AG, Switzerland or LumiNova® from the company Nemoto & Co. Ltd., Japan. These and other long-afterglow pigments 5 continue to glow for a very long time and intensively and, therefore, are well suited for the lamp 1 according to the invention.

In order to form the layers 6, the photoluminescent pigments 5 can be mixed with a compound and formed into a rod having a desired diameter, from which, finally, thin disks are cut, which form the layers 6. Such a layer 6 is situated in the sheath 3 on the inside of the viewing area 4 before the GTLS glass capsule 2 is introduced therebehind. It is important that the layer 6 is situated between the viewing area 4 and the GTLS glass capsule 2. Finally, the sheath 3 is tightly sealed at its open end 10, so that the pigments 5 remain protected against moisture in the interior space 11 of the sheath 3 and both the layer 6 as well as the GTLS glass capsule 2 remain fixed in position.

Alternatively or additionally, the GTLS glass capsule 2 within the sheath 3 is enclosed by a filling material 7. This filling material 7 dampens stresses between the GTLS glass capsule 2 and the sheath 3, whereby a glass breakage of the GTLS glass capsule 2 during temperature changes or upon the occurrence of vibrations can be largely prevented. Preferably, the filling material 7 comprises an adhesive, and so the sheath 3 is directly closed by the filling material 7. For this purpose, it suffices when the adhesive makes up approximately 5% to 10% by volume of the filling material 7. In some cases, the amount is even increased to approximately 20% by volume or more.

Figure 3:
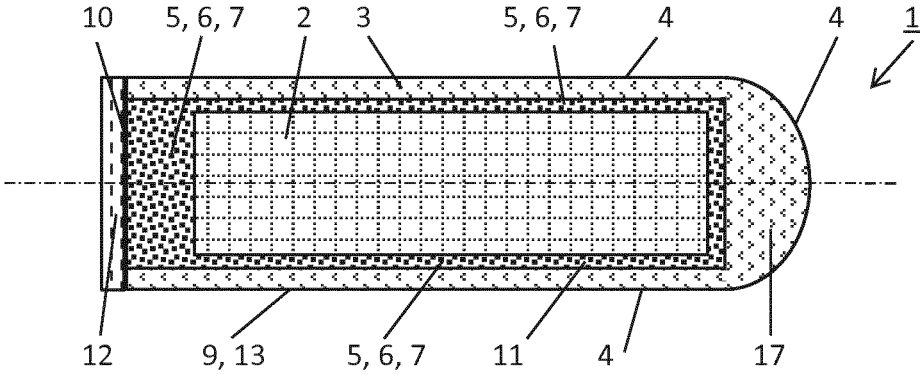
FIG. 3 shows a cross-section of one further alternative embodiment.

As represented in FIG. 3, the photoluminescent pigments 5 can be added to the filling material 7 of the lamp 1. As a result, the GTLS glass capsule 12 is surrounded on all sides by pigments 5. In this case, the layer 6 is formed by the filling material 7, to which the pigments 5 and the adhesive have been added.

It has proven not to be practicable to place the pigments 5 directly in the GTLS glass capsule 2, since the pigments 5 cannot be applied within the GTLS glass capsule 2 using the same coating method as for the phosphor. The pigments 5 decompose quickly upon contact with moisture.

In addition, the phosphors on the inner wall of the GTLS glass capsule must lie tightly packed next to one another in a single layer of approximately 10 μm, so that the electrons emitted by the tritium gas can generate the photons in this layer and, therefore, these photons can escape through the glass. One further layer over or under the phosphors would shade and, therefore, strongly reduce this process.

The pigments 5 therefore do not mix with the phosphors, nor can they be applied one above the other onto the inner surface. In addition, a glass is often utilized as the glass capsule 2, which has a low optical transmittance in the UV-A spectrum, whereby any pigments 5 within the GTLS glass capsule 2 can only poorly absorb energy. Since the GTLS glass capsule 2 is filled with radioactive gas, the escape of which is most undesirable, not just any glass can be utilized therefor. The pigments 5 outside the GTLS glass capsule 2 barely darken the permanent light in darkness because the pigments 5 are less densely packed and are surrounded by a transparent filling material.

The commercially available GTLS glass capsules 2 are generally designed as elongate tubes and, therefore, the sheaths 3 also preferably comprise a cylindrical wall 9. Due to the concentric arrangement of the GTLS glass capsules 2 in the sheaths 3, it is achieved that the filling material 7 has a uniform thickness around the lateral surface of the GTLS glass capsule 2.

In one preferred embodiment of the lamp 1, the sheath 3 is made of glass, in particular, sapphire glass, of ceramic, or of plastic. When the sheath 3 is completely transparent, its entire surface can absorb energy in the form of light, in particular UV light, which is stored in the photoluminescent pigments 5 and is later given off as light. As a result, the viewing area 4 is enlarged.

Such lamps 1 are particularly well suited for being mounted with their cylindrical walls 9 lying on a base, in order, for example, to generate an information sign such as a surface designed as an arrow. The lamps 1 can also be mounted on reflectors, as is known in the case of office lamps. Thus, the back sides of the lamps 1 can also absorb and give off light.

The rear end 10 of the sheath 3, which was formerly open, is sealed, for example, with the aid of an adhesive, with the aid of glass, ceramic, or with the aid of plastic. In addition, the sheath 3 can be provided with a light-reflecting layer 12 on the surface which is positioned opposite the viewing area 4. As a result, the light emitted toward the rear is reflected back toward the front, in the direction of the viewing area 4. In addition, light entering from the outside through the viewing area 4 is also reflected and, in this way, increases the visibility of the lamp 1.

Figure 4:
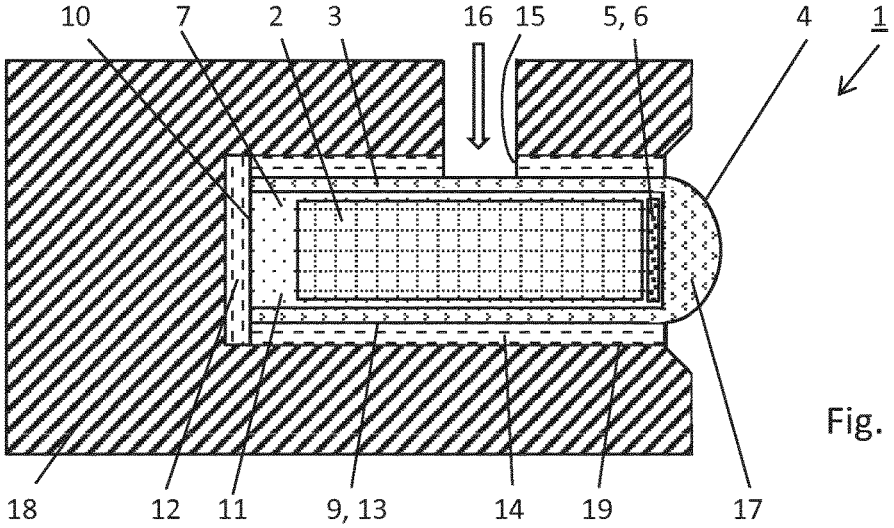
FIG. 4 shows a cross-section of the embodiment according to FIG. 2, installed in a device.

If the lamp 1 is utilized as a point of light, for example, in instruments or devices 18, the lamp 1 is introduced into a hole 19 in the device 18 provided therefor, as represented in FIG. 4. The viewing area 4 is then generally the closed front end of the sheath 3 designed as a tube. For this purpose, a lamp 1 according to FIG. 1, FIG. 2, or FIG. 3 can be optionally utilized, wherein the embodiments according to FIGS. 1 and 3 can also be combined.

The sheath 3 of the lamp 1 comprises an outer surface 13 which leaves room for the viewing area 4. The surface 13 is preferably at least partially covered by a light-reflecting casing 14 in order to optimize the light effect. A desirable light reflection can be achieved, for example, with the aid of a thin, vapor-deposited layer 14 made of silver, gold, aluminum, or chromium. Additionally or alternatively, for this purpose, a thicker layer such as a shrink tube which comprises a reflective inner surface can be utilized as the casing 14.

Such a casing 14 also acts as a shock absorbing mat between the lamp 1 and the device 18, into the hole 19 of which the lamp 1 has been installed, in order to prevent damage due to mechanical or thermal stresses or due to vibrations.

In addition, the casing 14 can comprise, in addition to the recess for the viewing area 4, a second recess 15 which, in the installed state, permits an incidence of light 16 by an external light when the light is appropriately provided in the device 18. If the installation position of the lamp 1 is far from the edge of the device 18, light can be guided by one or multiple light guides from the device edge to the second recess 15 (not represented). Due to this additional incidence of light, more energy can be stored in the photoluminescent pigments 5, whereby the luminosity is increased.

The sheath 3 can be designed as a lens 17 in the region of the viewing area 4, in particular as a diverging lens or a converging lens. The viewing areas 4 according to FIGS. 1, 2, 3 and 4 are designed as converging lenses.

Figure 5A:
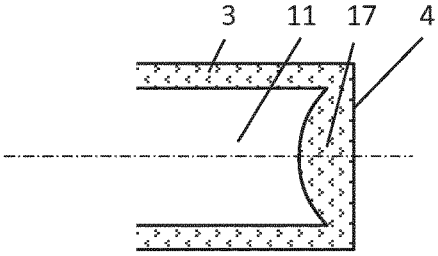
FIGS. 5*a*, 5*b* show alternative embodiments of the viewing area and the lenses.
Figure 5B:
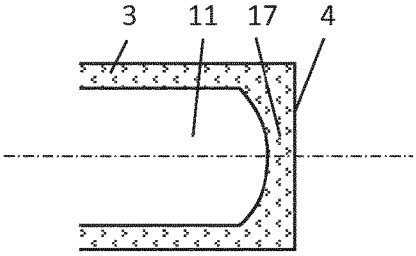

The viewing area 4 is designed to be planar in FIGS. 5*a* and 5*b*. As a result, the lamp 1 can be completely installed into a hole 19 and the viewing area 4 is flush with the device wall 18. Thus, no dirt collects around the viewing area 4 and the lamp 1 is also well protected against mechanical influences.

The contour of the interior space 11 in the direction toward the planar viewing area 4 can be designed to be convex, as represented in FIG. 5*a*, whereby a plano-convex converging lens 17 is formed. In FIG. 5*b*, on the other hand, the interior space 11 is designed to be concave in the direction toward the planar viewing surface 4, whereby a plano-concave diverging lens 17 is formed.

Figure 6:
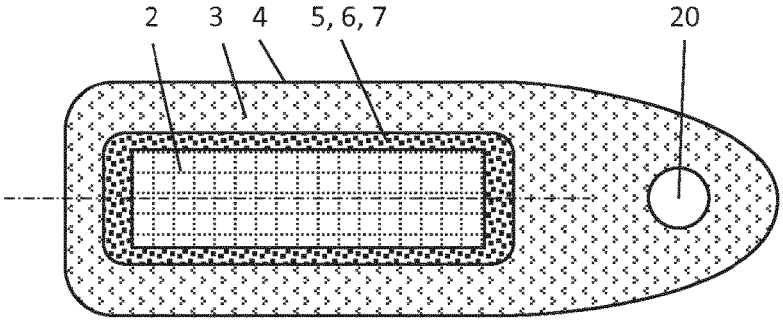
FIG. 6 shows a cross-section of one further alternative embodiment.

In FIG. 6, one further example of an application for the lamp 1 according to the invention, according to FIG. 3, is represented. The viewing area 4 therefore comprises at least the cylindrical wall 9 of the lamp 1. Here, the lamp 1 also comprises an attachment device 20, at which the lamp 1 can be attached to an object which must be found quickly in emergency situations. This attachment device 20 can be, for example, a hole through the sheath 3, through which a key ring, a mounting strip, or the like can be guided. For this purpose, the sheath 3 is made, for example, of plastic and extends for a sufficiently long extent along one side of the GTLS glass capsule 2 to not risk breakage of the GTLS glass capsule 2. Alternatively, an eyelet can be integrally formed on an end piece which is mounted on the lamp 1, for example, with the aid of an adhesive or via clamping.

For this purpose, an embodiment according to FIG. 1 can also be utilized, in which the utilized tube 3, which is open on both sides, is transparent and forms the viewing area 4. The component 8 therefore does not necessarily need to be transparent. The component 8 can be mounted on one side or both sides and contain the attachment device 20. The pigments 5 can be, in turn, added to a filling material 7 which encloses the GTLS glass capsule 2. Alternatively, a disk 6 including the pigments 5, which is described with reference to FIG. 1, can be wound around the GTLS glass capsule 2.

LIST OF REFERENCE CHARACTERS

1 lamp; permanently illuminating object
2 GTLS, GTLS glass capsule
3 sheath
4 viewing area
5 photoluminescent pigments
6 layer
7 filling material, filling material including adhesive
8 component
9 cylindrical wall of the sheath
10 rear or open end of the sheath
11 interior space
12 light-reflecting layer
13 surface
14 light-reflecting casing
15 second recess
16 incidence of light
17 lens
18 device, instrument
19 hole
20 attachment device

The invention claimed is:

1. An autonomous, permanently illuminating object for identifying important points in bright conditions, poor lighting, and in darkness, in particular for installation in instruments) or for attachment to items which must be found quickly in emergency situations, the illuminating object comprising:

a sheath defining an interior space;

a glass capsule;

a gaseous tritium light source (GTLS) disposed within the glass capsule, which is fixed in the sheath which defines a transparent viewing region;

a layer, which includes photoluminescent pigments, is disposed between the glass capsule and the viewing region of the sheath.

2. The illuminating object as claimed in claim 1, wherein the photoluminescent pigments are photoluminescence sources comprising strontium aluminate ($SrAl_2O_4$).

3. The illuminating object as claimed in claim 2, further comprising a filling material that is configured and disposed to enclose the glass capsule within the sheath.

4. The illuminating object as claimed in claim 3, wherein the filling material comprises an adhesive which makes up a portion of at least 5% by volume of the filling material.

5. The illuminating object as claimed in claim 1, further comprising a filling material that encloses the glass capsule within the sheath.

6. The illuminating object as claimed in claim 5, wherein the filling material comprises an adhesive which makes up a portion of at least 5% by volume of the filling material.

7. The illuminating object as claimed in claim 6, wherein the filling material includes photoluminescent pigments.

8. The illuminating object as claimed in claim 5, wherein the filling material includes photoluminescent pigments.

9. The illuminating object as claimed in claim 1, wherein the sheath includes a cylindrical wall.

10. The illuminating object as claimed in claim 1, wherein the sheath is made of glass, sapphire glass, ceramic, or plastic.

11. The illuminating object as claimed in claim 1, wherein the sheath is sealed with one of the following sealants: an adhesive, glass, ceramic, or plastic.

12. The illuminating object as claimed in claim 1, further comprising a light-reflecting layer positioned opposite the viewing region.

13. The illuminating object as claimed in claim 1, wherein the sheath comprises an outer surface which defines a first recess configured and disposed for receiving the viewing region and is at least partially covered by a light-reflecting casing.

14. The illuminating object as claimed in claim 13, wherein the casing defines a second recess configured and disposed to permit an incidence of light by an external light.

15. The illuminating object as claimed in claim 1, wherein the sheath defines a lens in the viewing region.

16. The illuminating object as claimed in claim 15, wherein the lens is a diverging lens.

17. The illuminating object as claimed in claim 15, wherein the lens is a converging lens.

18. The illuminating object as claimed in claim 1, wherein the viewing area is designed to be planar.

19. The illuminating object as claimed in claim 1, wherein the sheath comprises an attachment device for attachment to an object.

* * * * *